US005794418A

United States Patent [19]

Lai

[11] Patent Number: 5,794,418

[45] Date of Patent: Aug. 18, 1998

[54] PALLET STRETCH WRAPPING MACHINE

[76] Inventor: Robert Lai, 15th Fl.-6, No. 241, Sec. 3, Wen Hsin Rd., Taichung, Taiwan

[21] Appl. No.: 897,802

[22] Filed: Jul. 21, 1997

[51] Int. Cl.[6] ..... B65B 53/00

[52] U.S. Cl. ..... 53/556; 53/587; 53/389.4

[58] Field of Search ..... 53/556, 441, 587, 53/389.4

[56] References Cited

U.S. PATENT DOCUMENTS

| | | | |
|---|---|---|---|
| 4,409,777 | 10/1983 | White et al. | 53/587 |
| 4,590,746 | 5/1986 | Humphrey | 53/587 X |
| 4,727,254 | 2/1988 | Lancaster | 53/587 X |
| 4,934,123 | 6/1990 | Salzsauler | 53/441 X |
| 5,005,335 | 4/1991 | Yourgalite et al. | 53/441 X |
| 5,107,657 | 4/1992 | Diehl et al. | 53/556 X |
| 5,448,873 | 9/1995 | Jennings et al. | 53/587 X |

*Primary Examiner*—Linda Johnson
*Attorney, Agent, or Firm*—Heller Ehrman White & McAuliffe

[57] ABSTRACT

A pallet stretch wrapping machine includes a turntable attached to a lower portion of a column for supporting an article to be wrapped thereon. A frame is vertically movably mounted in the column and includes an upper housing, a lower housing, and a vertical wall connecting between the upper and lower housings. A plurality of upright rollers are rotatably mounted between the upper and lower housings. An upright post is fixedly mounted on the lower housing for supporting a spool. A roll of resilient film is wrapped around the spool and extends through each of the rollers which can co-operate to deliver the roll of resilient film to envelop the article by turning the turntable. A velocity adjusting mechanism is mounted between the upper and lower housings for adjusting a rotational velocity of each of the rollers for delivering the roll of resilient film.

6 Claims, 8 Drawing Sheets

PALLET STRETCH WRAPPING MACHINE

FIELD OF THE INVENTION

The present invention relates to a pallet stretch wrapping machine.

BACKGROUND OF THE INVENTION

A conventional pallet stretch wrapping machine is shown in FIG. 8, and a complete illustration will follow in the detailed description of the preferred embodiments.

The present invention has arisen to mitigate and/or obviate the disadvantage of the conventional pallet stretch wrapping machine.

SUMMARY OF THE INVENTION

In accordance with one aspect of the present invention, there is provided a pallet stretch wrapping machine which comprises a turntable attached to a lower portion of a column for supporting an article thereon.

A frame is vertically movably mounted in the column and includes an upper housing, a lower housing disposed under the upper housing, and a vertical wall connecting between the upper and lower housings.

A plurality of upright rollers are rotatably mounted between the upper and lower housings. An upright post has a lower portion fixedly mounted on the lower housing, and a spool is rotatably mounted on the upright post.

A roll of resilient film is wrapped around the spool and extends through each of the rollers which can co-operate to deliver the roll of resilient film so as to envelop the article.

A velocity adjusting mechanism is mounted between the upper and lower housings for adjusting a rotational velocity of each of the rollers for delivering the roll of resilient film.

Further features of the present invention will become apparent after a careful reading of the detailed description with appropriate reference to the accompanying drawings.

DETAILED DESCRIPTION OF THE PREFERRED EMBODIMENTS

Figure 8:
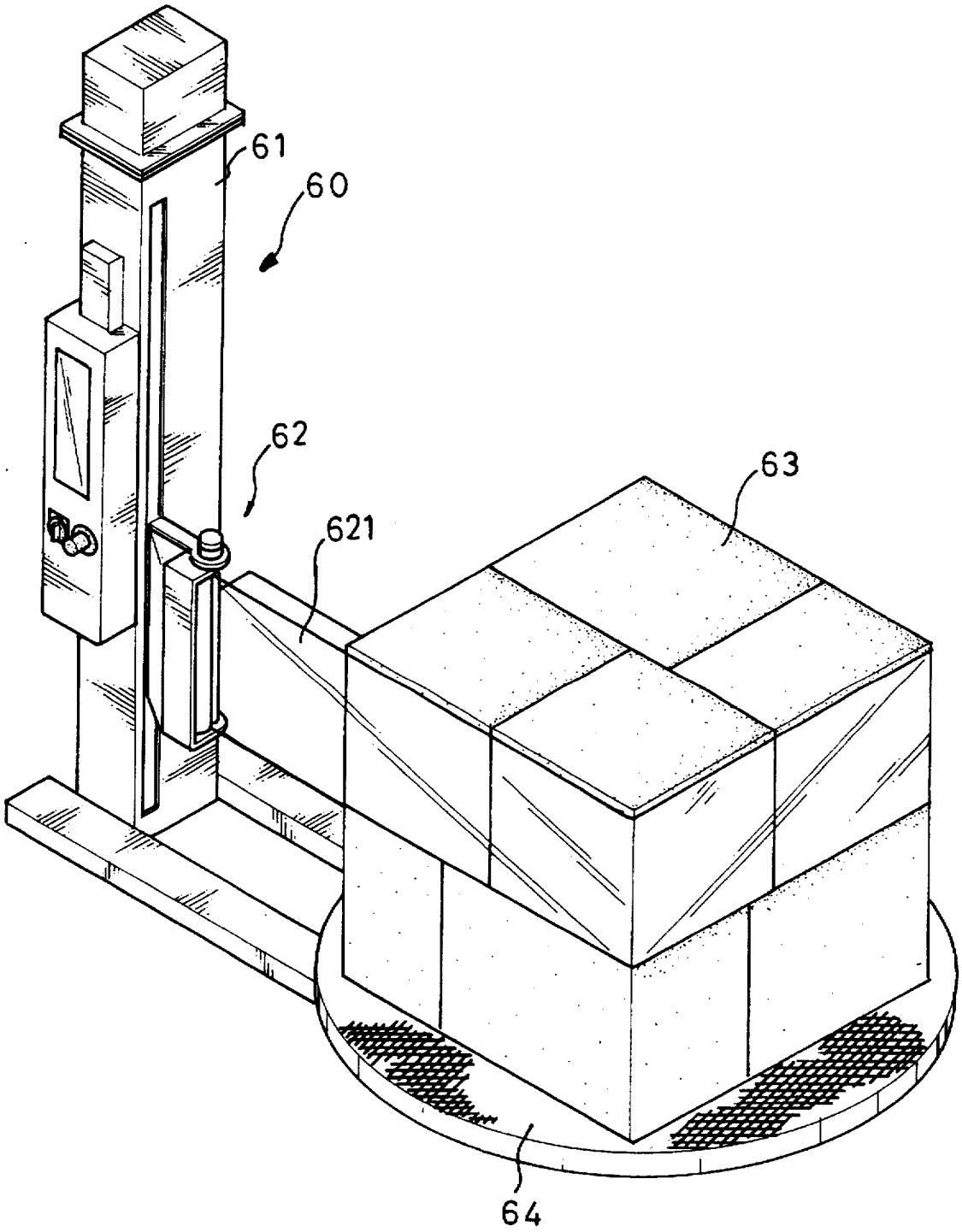
FIG. 8 PRIOR ART
FIG. 8 is a perspective view of a conventional pallet stretch wrapping machine in accordance with the prior art.

For a better understanding of features and benefits of the present invention, reference is now made to FIG. 8, illustrating a conventional pallet stretch wrapping machine 60 according to the prior art.

The pallet stretch wrapping machine 60 includes a column 61, a an arm 62 vertically movably mounted in the column 61, a turntable 64 attached to the column 61 for supporting an article 63 such as a cardboard box, and a resilient plastic film 621 delivered by rollers (not shown) mounted in the frame 62 to envelop the article 63.

By such an arrangement, however, if the article 53 has an irregular shape, i.e., the tension transmitted from the article 63 to the plastic film 621 is variable, the plastic film 621 is easily deformed or even torn when a great tension is exerted on the plastic film 621 by the article 63.

Referring now to FIGS. 1–4, a pallet stretch wrapping machine in accordance with the present invention can be used to wrap and pack an article 53 such as a cardboard box and the like.

The pallet stretch wrapping machine includes a column 11 vertically disposed, and a turntable 12 attached to a lower portion of the column 11 for supporting the article 53 thereon.

A frame 10 is vertically movably mounted in the column 11 and includes an upper housing 101, a lower housing 102 disposed under the upper housing 101, and a vertical wall 103 connecting between the upper and lower housings 101, 102. The upper housing 101 has a bottom wall defining a first elongate slot 22, and the lower housing 102 has a top wall defining a second elongate slot 40 and aligning with the first elongate slot 22.

A plurality of upright rollers 15 are rotatably mounted between the upper and lower housings 101, 102. An upright post 14 has a lower portion fixedly mounted on the lower housing 102. A spool 52 is rotatably mounted on the upright post 14. A roll of resilient plastic film 521 is wrapped around the spool 52 and extends through each of the rollers 15 which can co-operate to deliver the roll of resilient plastic film 521 to envelop the article 53.

A velocity adjusting mechanism is mounted between the upper and lower housings for adjusting a rotational velocity of each of the rollers 15 for delivering the roll of resilient plastic film 521.

The velocity adjusting mechanism comprises an upright tension adjusting rod 20 urged on the resilient plastic film 521 and having an upper end portion 201 movably received in the first slot 22 and a lower end portion 202 movably received in the second slot 40.

A first rack 21 is fixedly mounted on the bottom wall of the upper housing 101 and is located adjacent to a first side of the first slot 22. A first gear 23 is fixedly mounted on the upper end portion 201 of the tension adjusting rod 20 and meshes with the first rack 21.

A sprocket 24 is fixedly mounted on the upper end portion 201 of the tension adjusting rod 20 and is supported on the first gear 23.

A positioning plate 32 located adjacent to one end of the first rack 21 is fixedly mounted on the bottom wall of the upper housing 101 and defines a hole 320. A drawing rod 30 includes a first end extending through the hole 320 and a second end with an enlarged head 302. A biasing member 31 is mounted between the positioning plate 32 and the enlarged head 302. A chain 33 includes a first end 330 fixedly attached to the sprocket 24 to rotate therewith and a second end 332 fixedly attached to the first end of the drawing rod 30.

A recessed wheel 25 is fixedly mounted on the upper end portion 201 of the tension adjusting rod 20 and is supported on the sprocket 24. A supporting bracket 34 is fixedly mounted on the bottom wall of the upper housing 101 for supporting a retaining rod 341 which is located adjacent to a second side of the first slot 22 and extends through one side wall of the upper housing 101 for limiting the recessed wheel 25 to move along a straight direction.

A second rack 41 is fixedly mounted on the top wall of the lower housing 102 and is located adjacent to a first side of the second slot 40. A second gear 43 is fixedly mounted on the lower end portion 202 of the tension adjusting rod 20 and meshes with the second rack 41.

A recessed wheel 431 is fixedly mounted on the lower end portion 202 of the tension adjusting rod 20. Two spaced supporting brackets 42 are fixedly mounted on the top wall of the lower housing 102 for supporting a retaining rod 421 which is located adjacent to a second side of the second slot 40 for limiting the recessed wheel 431 to move along a straight direction.

A variable resistor 451 is fixedly mounted on the top wall of the lower housing 102, and a knob 452 is rotatably mounted on the variable resistor 451 for adjusting the resistance of the variable resistor 451.

A supporting plate 45 includes a first end fixedly mounted on the top wall of the lower housing 102, and a second end defining a hole 453 for receiving the knob 452.

A swing plate 44 includes a first end portion formed with a lug 442 defining a chamber 444 for receiving the knob 452, and a positioning bolt 443 extends through a threaded cavity (not shown) defined in the lug 442 to urge on the knob 452, thereby securing the lug 442 on the knob 452.

The swing plate further includes a second end portion pivotally connected with the lower end portion 202 of the tension adjusting rod 20.

Preferably, the lower end portion 202 of the tension adjusting rod 20 defines a threaded socket 204 (see FIG. 4) therein. The second end portion of the swing plate 44 abuts on the lower end portion 202 of the tension adjusting rod 20 and defines an elongate opening 441 therein. A retaining bolt 432 extends through the elongate opening 441 and is loosely engaged in the threaded socket 204 such that the retaining bolt 432 can move along the elongate opening 441.

Figure 1:
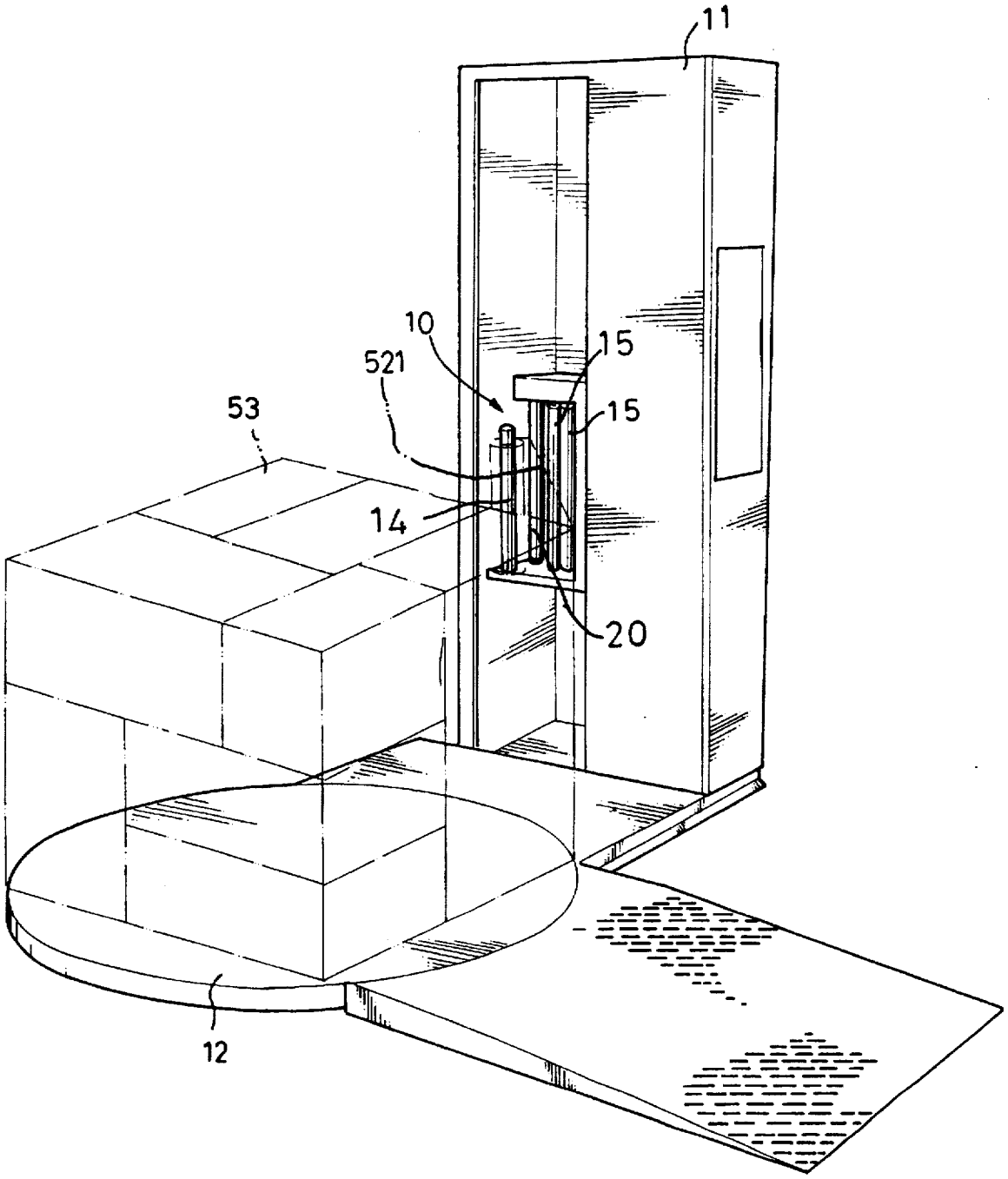
FIG. 1 is a perspective view of a pallet stretch wrapping machine according to the present invention.
Figure 2:
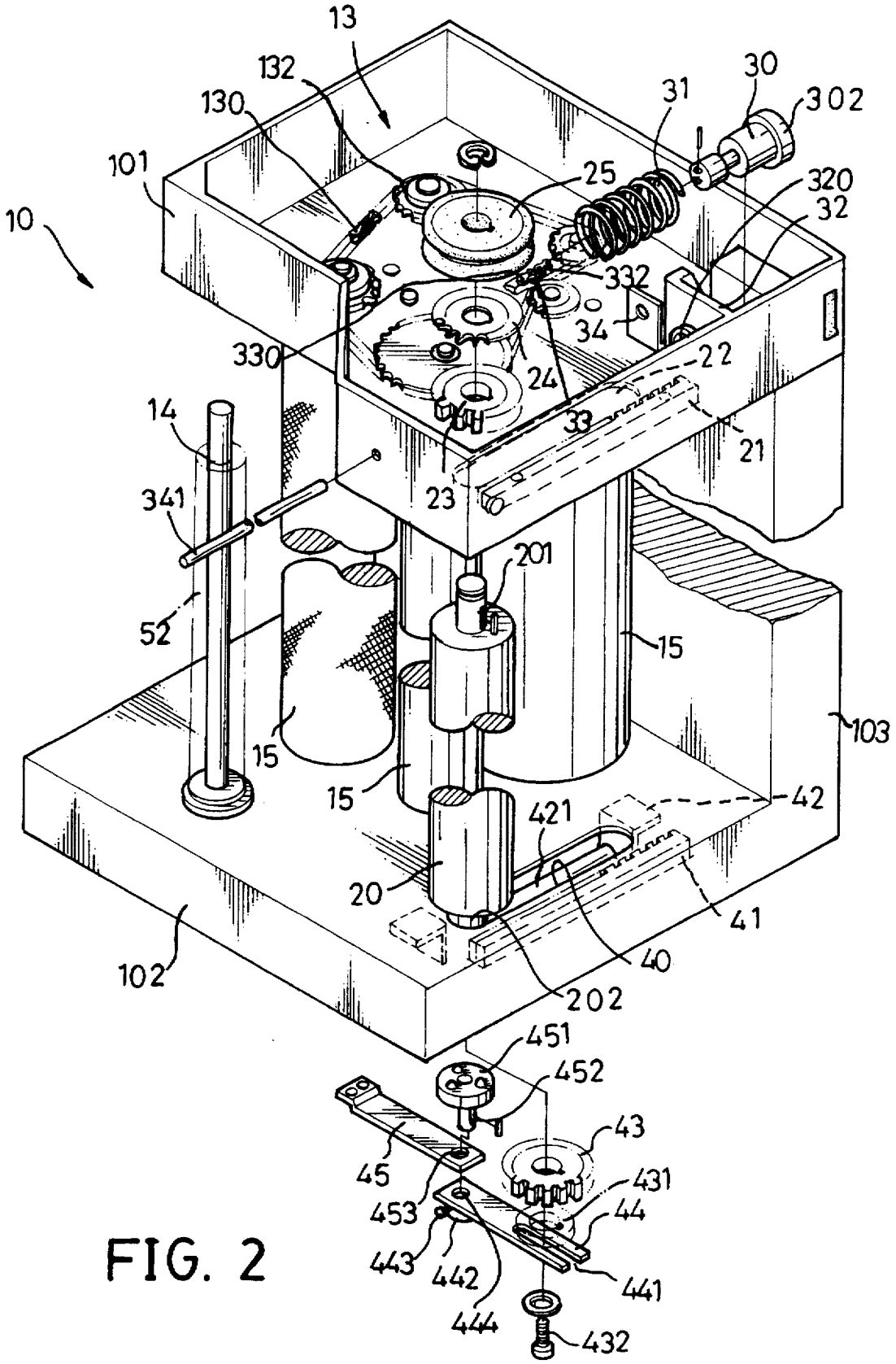
FIG. 2 is a partially exploded view of a frame of the pallet stretch wrapping machine.
Figure 3:
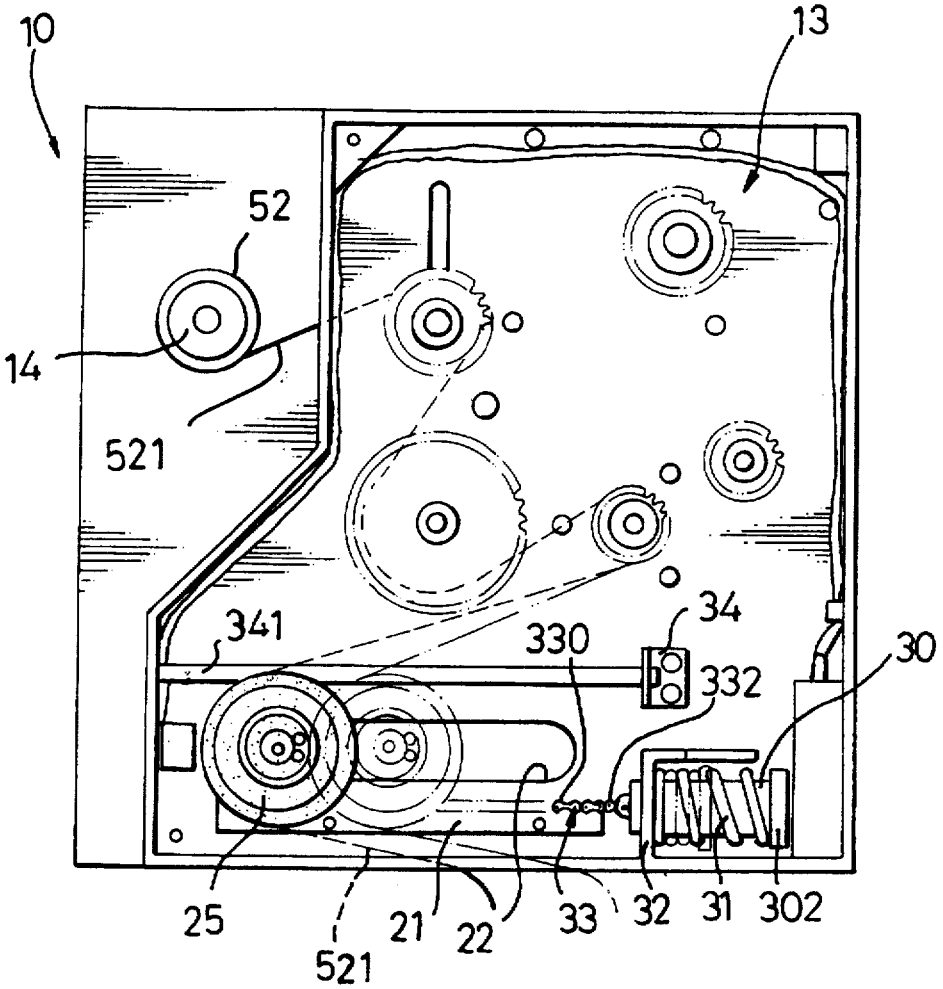
FIG. 3 is a top plan view of FIG. 2.
Figure 4:
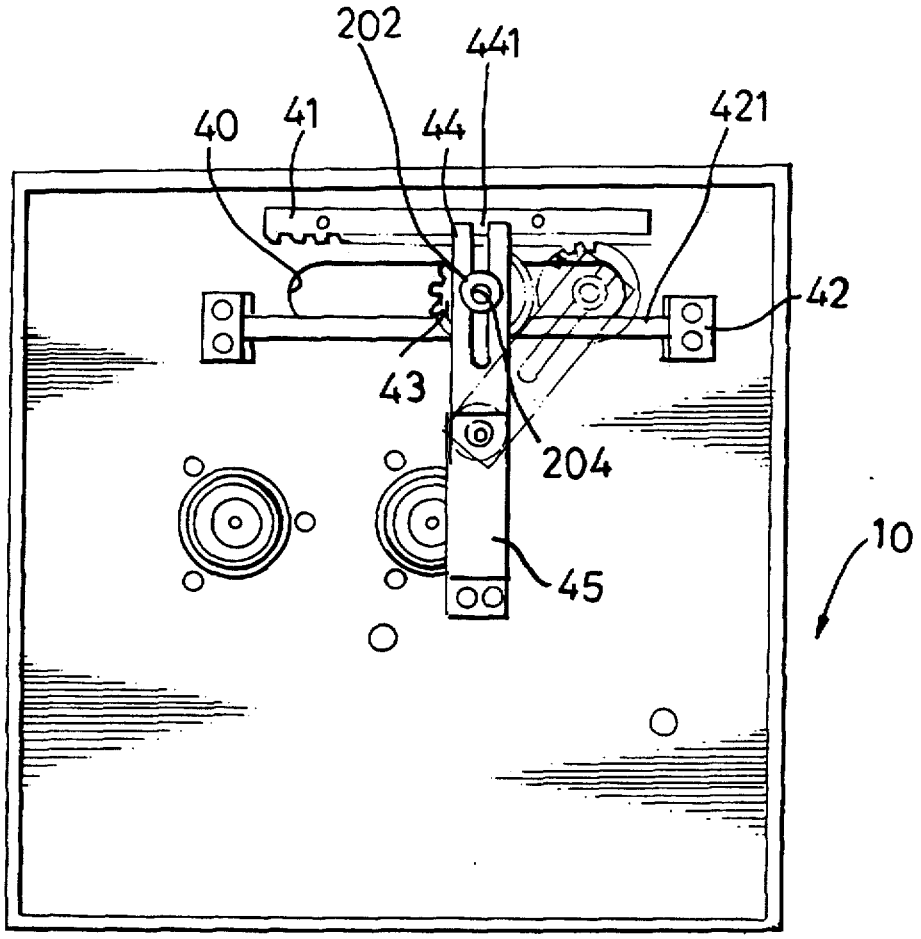
FIG. 4 is a bottom plan view of FIG. 2.

In operation, referring to FIGS. 3 and 4 with reference to FIGS. 1 and 2, a motor (not shown) disposed in the upper housing 101 can be used to actuate a transmission mechanism 13 including a plurality of gears 132 co-operating with a chain 130.

The transmission mechanism can then in turn rotate the plurality of rollers 15 for delivering the roll of plastic film 521 extending from the spool 52 to wrap the article 53 which is being turned by the turntable 12. The frame 10 can be moved vertically in the column 11, thereby entirely packing the article 53.

If the article 53 has an irregular shape, i.e., the tension transmitted from the article 53 to the plastic film 521 is variable, a force exerted on the tension adjusting rod 20 by the plastic film 521 will force the tension adjusting rod 20 together with the recessed wheel 25 to a position as shown in phantom lines in FIG. 3.

At the same time, the second end of the swing plate 44 can be moved with the lower end portion 202 of the tension adjusting rod 20 to a position as shown in phantom lines in FIG. 4 such that the tension adjusting plate 20 can be pivoted relative to the variable resistor 451 to rotate the knob 452, thereby decreasing the resistance of the resistor 451 exerted on the motor and thus increasing the rotational velocity of each of the rollers 15 so as to deliver the plastic film 521 more rapidly to conform to the rotational velocity of the article 53.

During straight moving of the tension adjusting rod 20 along the first and second slots 22 and 40, the first and second gears 24 and 43 can be rotated relative to the first and second racks 21 and 41 respectively, thereby rotating the sprocket 24 which pulls the chain 33 so as to move the drawing rod 30, thereby compressing the biasing member 31.

When the force exerted on the tension adjusting rod 20 by the plastic film 521 is removed, the drawing rod 30 can be returned to its original position by a returning force of the biasing member 31, thereby urging the chain 33 which in turn rotates the sprocket 24 and the first gear 23 along a reverse direction, thereby moving the tension adjusting rod 20 to its original position.

At the same time, the swing plate 44 can be returned to its original position, thereby rotating the knob 452 to its original position so as to return to the original resistance of the resistor 451 exerted on the motor.

Figure 5:
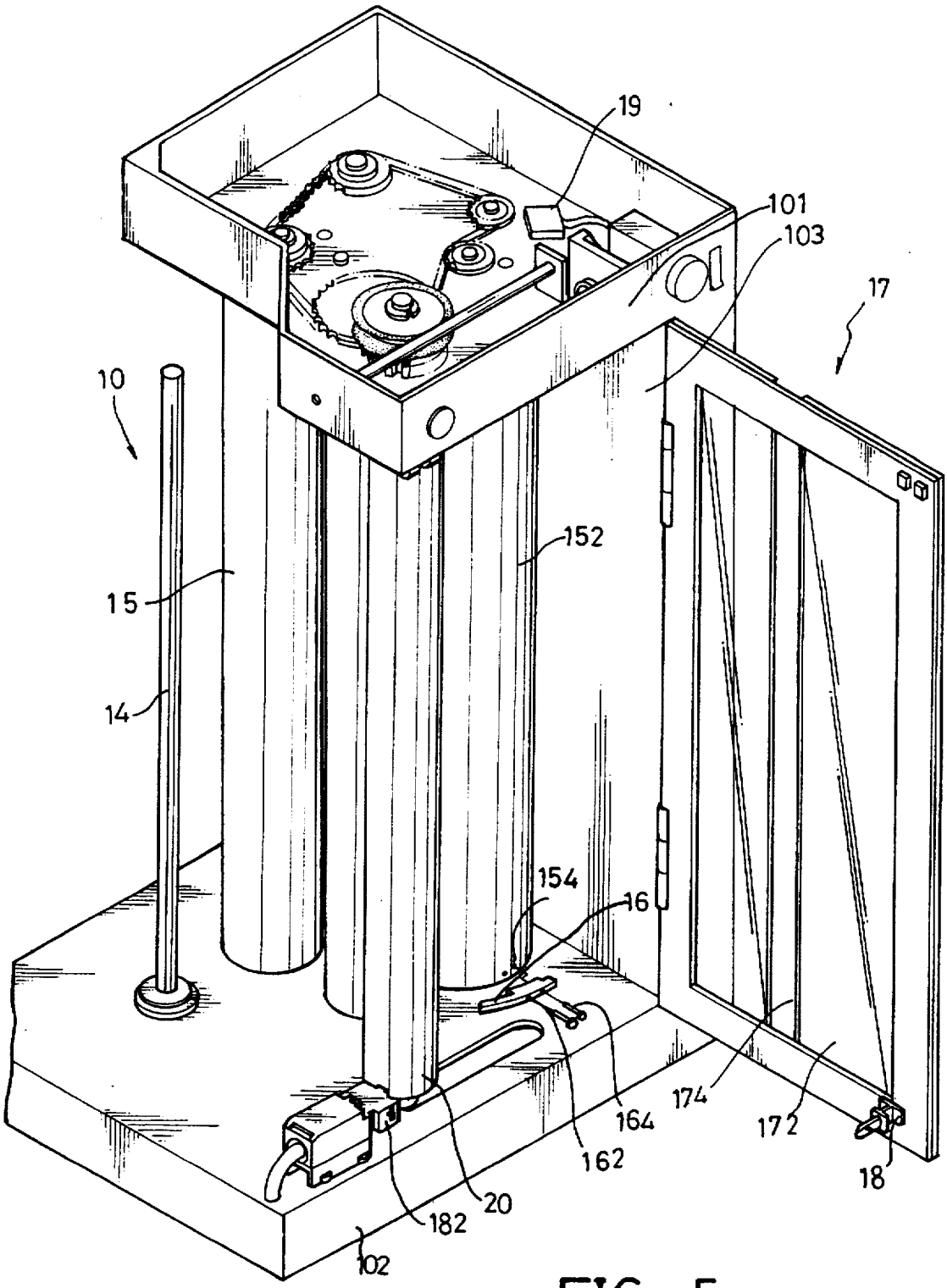
FIGS. 5 and 6 are perspective views of the frame in accordance with another embodiment of the present invention.
Figure 6:
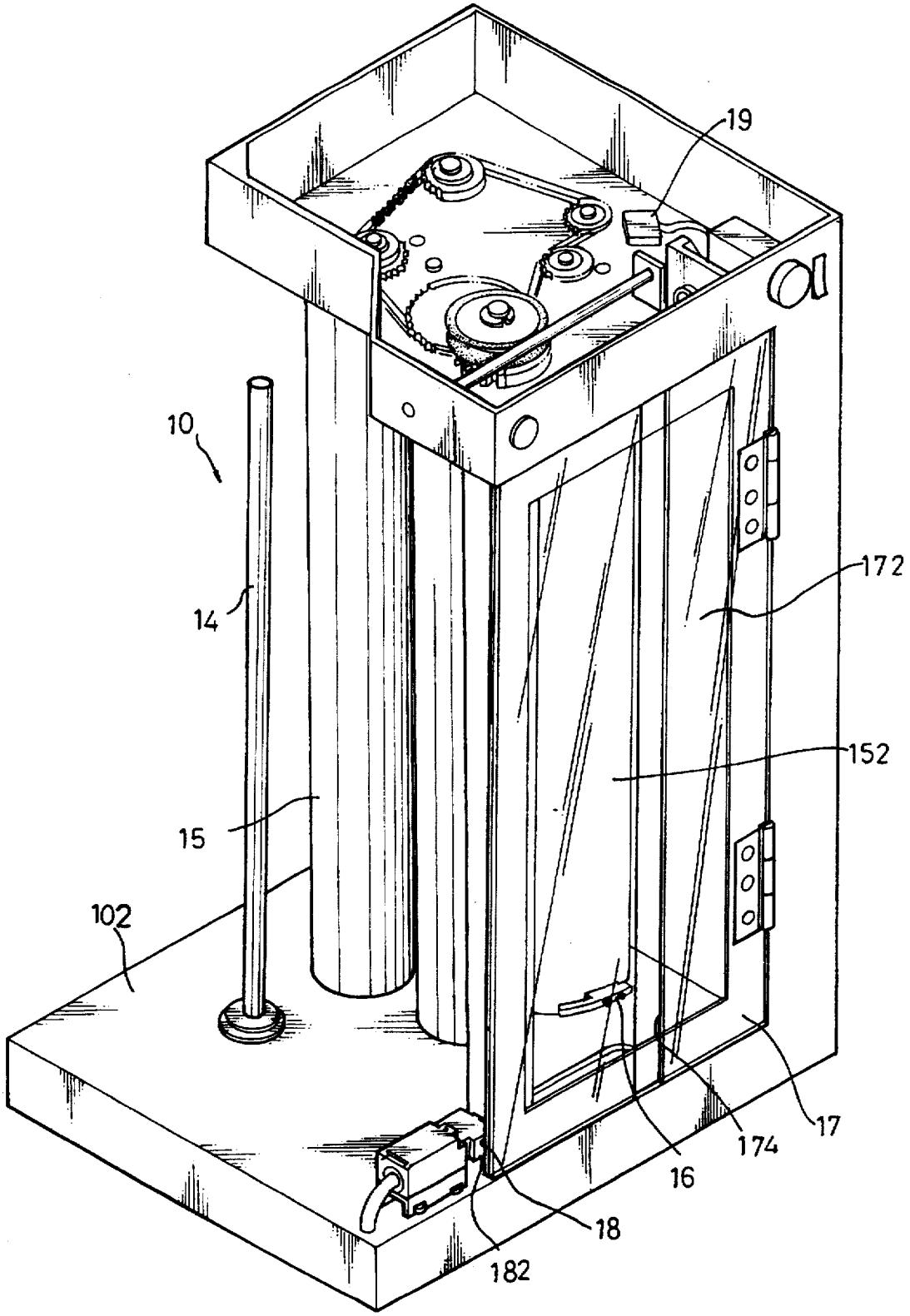
Figure 7:
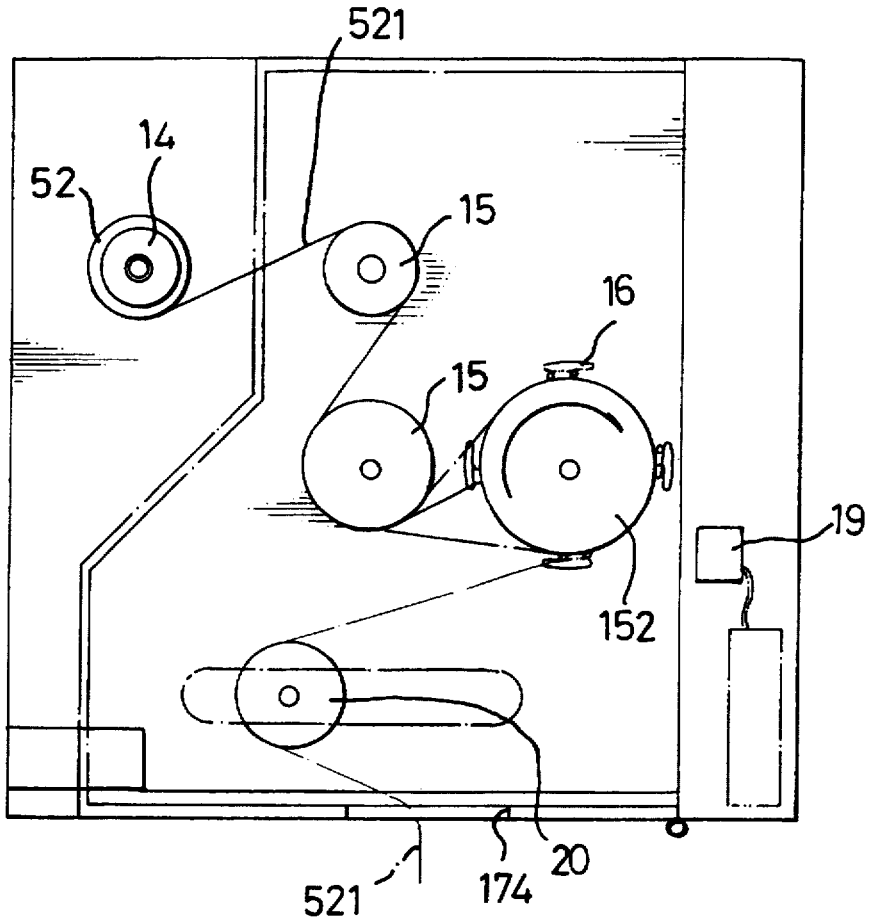
FIG. 7 is a partially cut-away top plan view of FIG. 6.

Referring now to FIGS. 5–7, in accordance with another embodiment of the present invention, a roller 152 is located adjacent to the vertical wall 103 of the frame 10 as shown in FIG. 7 such that it is difficult to stretch the plastic film 521 through the roller 152 manually.

In such a situation, a hook 16 can be fixedly mounted on the upright roller 152 for hooking the resilient film 521 thereon. The hook 16 defines two bores 162, the roller 152 defines two threaded bores 154, and two positioning bolts 164 each extend through the bore 162 and are each engaged in a respective one of the threaded bores 154.

The plastic film 521 can be initially wrapped on the hook 16 and the roller 152 can be rotated by activation of a switch 19 such that the plastic film 521 can be wound around the roller 152 by electric power instead of manually and can then be pulled outwardly manually to extend through the tension adjusting rod 20 as shown in FIG. 7.

A safety door 17 is pivotally mounted between the upper and lower housings 101 and 102, and two transparent baffles 172 are mounted in the safety door 17 with a space 174 defined therebetween such that the plastic film 521 can extend through the space 174.

A male contact switch 18 can be inserted into a female contact switch 182 when the safety door 17 is closed such that the rollers 15 and 152 can be actuated to rotate by the motor in the upper housing 101 so as to deliver the plastic film 521.

When the safety door 17 is opened, the male contact switch 18 is detached from the female contact switch 182 so as to stop the motor, thereby ensuring a user's safety.

It should be clear to those skilled in the art that further embodiments of the present invention may be made without departing from the scope and spirit of the present invention.

What is claimed is:

1. A pallet stretch wrapping machine comprising:

a column vertically disposed;

a turntable attached to a lower portion of said column for supporting an article thereon;

a frame vertically movably mounted in said column and including an upper housing having a bottom wall defining a first elongate slot, a lower housing having a top wall defining a second elongate slot disposed under said upper housing, and a vertical wall connecting between said upper and lower housings;

a plurality of upright rollers rotatably mounted between said upper and lower housings;

an upright post including a lower portion fixedly mounted on said lower housing;

a spool rotatably mounted on said upright post;

a roll of resilient film wrapped around said spool and extending through each of said rollers, said rollers co-operating to deliver said roll of resilient film to envelop said article; and a velocity adjusting mechanism mounted between said upper and lower housings for adjusting a rotational velocity of each of said rollers for delivering said roll of resilient film, said velocity adjusting mechanism comprising an upright tension adjusting rod urged on said resilient film and having an upper end portion movably received in said first slot and a lower end portion movably received in said second slot, a first rack fixedly mounted on said bottom wall of said upper housing, a first gear fixedly mounted on said upper end portion of said tension adjusting rod and meshing with said first rack, a second rack fixedly mounted on said top wall of said lower housing, a second gear fixedly mounted on said lower end portion of said tension adjusting rod and meshing with said second rack, a variable resistor fixedly mounted on said top wall of said lower housing, a knob rotatably mounted on said variable resistor for adjusting the resistance of said variable resistor, and a swing plate having a first end portion fixedly mounted on said knob and a second end portion pivotally connected with the lower end portion of said tension adjusting rod.

2. The pallet stretch wrapping machine according to claim 1, wherein the lower end portion of said tension adjusting rod defines a threaded socket therein, said second end portion of said swing plate abutting on the lower end portion of said tension adjusting rod and defining an elongate opening therein, and a retaining bolt extending through said elongate opening and threadedly engaged in said threaded socket.

3. The pallet stretch wrapping machine according to claim 1, further comprising a sprocket fixedly mounted on the upper end portion of said tension adjusting rod, a positioning plate fixedly mounted on said bottom wall of said upper housing and defining a hole, a drawing rod including a first end extending through said hole and a second end with an enlarged head, a biasing member mounted between said positioning plate and said enlarged head, and a chain including a first end fixedly attached to said sprocket to rotate therewith and a second end fixedly attached to the first end of said drawing rod.

4. The pallet stretch wrapping machine according to claim 1, further comprising a hook fixedly mounted on one of said plurality of upright rollers for hooking said resilient film thereon.

5. The pallet stretch wrapping machine according to claim 4, wherein said hook defines at least one bore, said roller defines at least one threaded bore, and at least one positioning bolt extends through said bore and is engaged in said threaded bore.

6. The pallet stretch wrapping machine according to claim 4, further comprising a safety door pivotally mounted between said upper and lower housings.

* * * * *